US005348297A

United States Patent [19]

Parsons

[11] Patent Number: 5,348,297

[45] Date of Patent: * Sep. 20, 1994

[54] EXPANDABLE BATON WITH LOCKING JOINTS

[76] Inventor: Kevin L. Parsons, 16 Wagon Wheel Dr., Appleton, Wis. 54915

[ * ] Notice: The portion of the term of this patent subsequent to Jun. 21, 2005 has been disclaimed.

[21] Appl. No.: 100,873

[22] Filed: Jul. 26, 1993

Related U.S. Application Data

[63] Continuation of Ser. No. 753,006, Aug. 23, 1991, abandoned, which is a continuation of Ser. No. 587,488, Sep. 20, 1990, abandoned, which is a continuation of Ser. No. 255,078, Oct. 7, 1988, abandoned.

[51] Int. Cl.[5] ..... F41B 15/02

[52] U.S. Cl. ..... 273/84 R

[58] Field of Search ..... 273/84 R, 84 ES, 32 F, 273/80 D, 68, 69; 135/75, 107; 343/901; D21/100

[56] References Cited

U.S. PATENT DOCUMENTS

| | | | |
|---|---|---|---|
| 1,909,932 | 5/1933 | Digel . | |
| 3,371,930 | 3/1968 | Shiga | 273/84 |
| 3,554,546 | 1/1971 | Braunhut | 273/84 |
| 4,037,839 | 7/1977 | Nelson | 273/84 |
| 4,135,719 | 1/1979 | Braunhut | 273/84 |
| 4,492,377 | 1/1985 | Eby | 273/84 R |
| 4,533,140 | 8/1985 | Champion | 273/84 R |
| 4,667,958 | 5/1987 | Raitto | 273/84 R |
| 4,752,072 | 7/1988 | Parsons | 273/84 R |

FOREIGN PATENT DOCUMENTS

| | | | |
|---|---|---|---|
| 543517 | 7/1957 | Canada | 273/84 R |
| 356481 | 7/1922 | Fed. Rep. of Germany . | |
| 16565 | 7/1902 | United Kingdom . | |

OTHER PUBLICATIONS

"Materials Science in Engineering", Carl Keiper 2nd ed. ©1969 by Bell & Howell Co. pp. 50, 52, 53.

The Advanced Balisong Manual, pp. 1, 5, 7 & 8 by Jeff Imada, 1986.

Undated ad from Imada for "professional telescopic staff" baton.

Undated ad from Monadnock for SX-24 and PR-24X expandable batons.

*Primary Examiner*—Vincent Millin

*Assistant Examiner*—William M. Pierce

*Attorney, Agent, or Firm*—Robert C. Curfiss

[57] ABSTRACT

An expandable baton is constructed of heat treatable alloy steel and is formed according to a method which provides both ease of workability of the component materials and strength for the resultant baton. The disclosed method comprises the steps of first forming the sections from heat treatable alloy steel, then annealing the baton components to soften them, then forming the components into the desired shapes, and finally hardening the components. The resulting baton provides the strength and reliability required in such a device.

4 Claims, 1 Drawing Sheet

EXPANDABLE BATON WITH LOCKING JOINTS

This is a continuation of application Ser. No. 07/753,006 filed Aug. 23, 1991, now abandoned, which is a continuation of application Ser. No. 07/587,488 filed Sep. 20, 1991 now abandoned, which is a continuation of application Ser. No. 07/255,078 filed Oct. 7, 1988, now abandoned.

BACKGROUND OF THE INVENTION

The field of the invention is expandable batons, or night sticks and, more particularly, to expandable batons which comprise two or more rigid telescoping sections. This invention is also directed to a method of manufacture for the aforementioned expandable batons.

Expandable batons are commonly used by policemen as an alternative to fixed length, one piece night sticks. The latter are usually made of hardwood and measure approximately 26 inches long by 1¼ inch in diameter. Expandable batons are preferred because they are more convenient to carry than one piece night sticks. The expandable baton includes a hollow main section which serves as a handle. Each of the telescoping sections has a diameter progressively smaller than the inside of the handle. When collapsed, the telescoping sections are nested inside the handle.

Expandable batons come in a variety of sizes, but usually consists of three telescoping sections. The longest sizes of expandable batons extend to a length comparable to a one piece night stick. In the closed position, a three section expandable baton is just over one third of its extended length, owing to the overlap of the section.

Shorter expandable batons are also available for even greater carrying convenience at the expense of extended length. Such a short baton might measure, for example, six inches in length closed and 16 inches extended.

To be effective, the expandable baton must be capable of being extended and locked in place very quickly and simply. This is because the baton may be needed suddenly and in a crisis situation. The most common mechanism for locking the telescoping sections in place is a deadlock taper joint, comprising a swage on one end of an outer telescoping section and a mating flare on an inner telescoping section. In that case, the baton is simply extended by sharply swinging the handle in an arc. Doing so causes the inner telescoping sections to be thrust outward by centrifugal force, until the flares and swages engage. When swung hard enough, the sections are locked together so tightly that only a sharp axial blow on a very hard object, for example, a concrete wall or pavement, can break the deadlock joint between sections.

However, prior expandable batons have failed to gain widespread popularity, primarily because of manufacturing tradeoffs that had been necessary in their construction. Specifically, it was first desired to use relatively soft steel for the handle and telescoping sections to facilitate the swaging and flaring operations. This results in ease of manufacture and a corresponding low cost. While such batons continue to be manufactured, they suffer a serious drawback. While soft steel is easily worked, it is also relatively weak. When the telescoping sections are locked together there is a tremendous amount of stress at the joints, both from the locking tension and bending moments during use. Batons made of soft steel are therefore highly prone to separation at the joints. In fact, telescoping sections have been known to literally "fly apart" during the extension thrust as the soft metal of the swedge opens up and the soft metal of the flare collapses, thereby allowing the inner section to pass straight through the outer section at the joint.

Because of the circumstances under which expandable batons are used, the degree of unreliability imparted by the use of soft steel in their construction is totally unacceptable. Attempts have been made to produce batons from harder steels. Such batons perform satisfactorily, but are extremely expensive to manufacture. Special tooling is required and the service life of such tooling is reduced in working with hardened steels. Also, the rejection rate is high due to brittleness of the hardened steel as it is swaged and flared. In the finished expandable baton, this brittle steel tends to crack, allowing the same straight through separation as previously discussed.

SUMMARY OF THE INVENTION

The present invention provides a method for manufacturing a expandable baton which provides a strong yet easily manufactured baton. The method of this invention comprises the following steps. The first step is forming heat treatable alloy steel into a main section and a telescoping section. The second step is annealing the main section and the telescoping section by heat treating. After annealing the main section and the telescoping section, the next step is forming a portion of a joint on both the main and telescoping sections such that the joint portions on the main and telescoping sections form a complete joint when the baton is in an extended position. After forming the joint, the last step is hardening the main and telescoping sections by heat treating.

A main advantage of this invention is that an extremely strong baton is produced without the necessity of forming joints in hard, brittle steel. By using heat treatable alloy steel for the main and telescoping sections, the joints are easily formed after annealing, while the hardening step produces a strong, reliable joint. The hardening step may result, for example, in a hardness of 30 Rockwell C Scale or higher, and may be performed by an austempering process.

An object of the method of this invention is to produce a baton with an easily locked, strong, and reliable joint. The method of forming the joint portions on the main and telescoping sections may comprise the steps of swaging one end of the main section and flaring one end of the telescoping section. The flared end of the telescoping section is mated to form a deadlock joint with the swaged end of the main section.

Another object of the method of the invention is to produce a baton which includes a plurality of telescoping sections with progressively smaller diameters. In that case, each joint between the telescoping sections comprises a flare on one section in mating engagement with a swage on the adjoining telescoping section. The method of forming the swages and flares follows the same steps of forming the sections, annealing, forming the swages and flares, and then hardening.

Another aspect of this invention is the expandable baton produced by the method of this invention. A expandable baton of this invention includes a main section having a hollow interior. The main section is formed of a heat treatable alloy steel. A telescoping section formed of a heat treatable alloy steel and is movable between a retracted position and an extended position. The telescoping section is disposed within the interior of the main section in the retracted position. A joint is formed on portions of the main and telescoping sections for retaining the telescoping member in the extended position. The main and telescoping sections are first annealed by heat treating, then formed with the joint portions, and then hardened by heat treating.

The joint may comprises a swage on one end of the main section which mates with a flare on one end of the telescoping section. The expandable baton may further include a plurality of telescoping sections, each telescoping section being formed of heat treatable alloy steel, and each joint between the telescoping sections comprising a swage on one end of one of the telescoping sections in mating engagement with a flare on the adjoining telescoping section.

The advantages of manufacturing ease together with strength of the resulting baton provided by this invention result from the utilization of heat treatable alloy steel for the baton members. In any expandable baton of the type which includes a main section, at least one telescoping section, and a joint between each section for holding the baton in an extended position, this invention provides the improvement wherein the main section and all telescoping sections are formed of heat treatable alloy steel.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
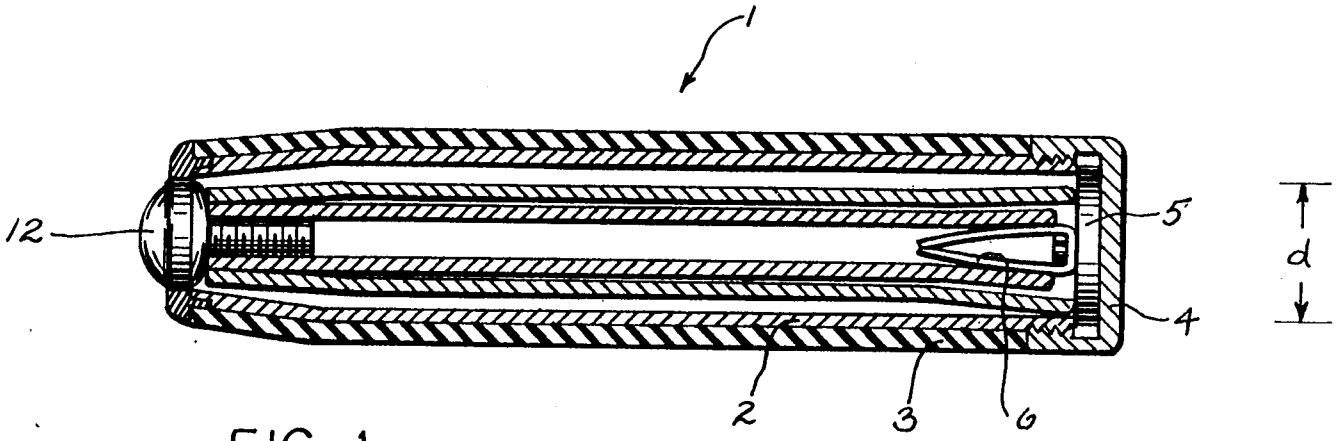
FIG. 1 is a sectional view of an expandable baton of this invention in the retracted position.
Figure 2:
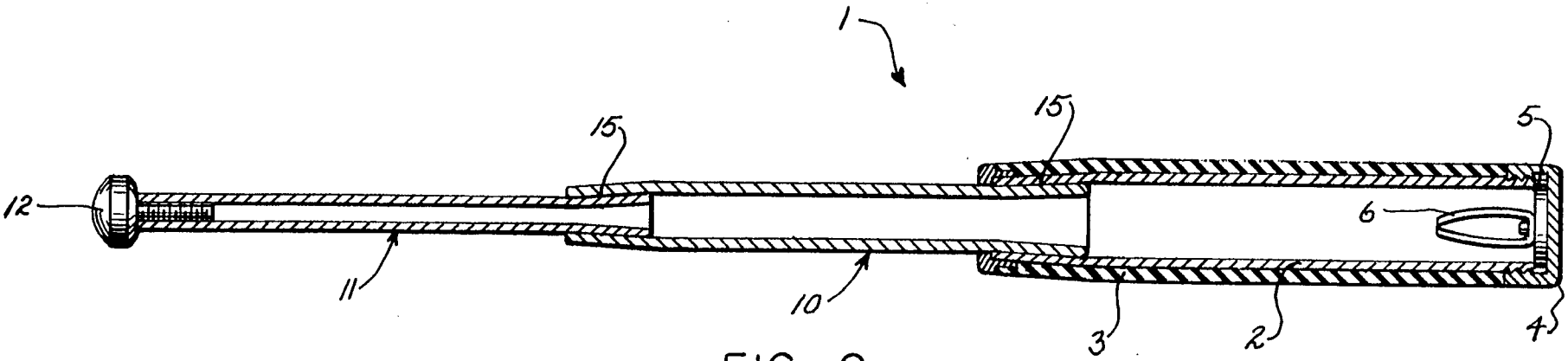
FIG. 2 is a sectional view of the expandable baton of FIG. 1 in the extended position.

An expandable baton 1 according to the present invention is shown in a retracted position in FIG. 1 and in an extended position in FIG. 2. A main section 2 of the baton 1 serves as a handle and is formed from a hollow tube with an inner diameter d of approximately one inch. The main section 2 is covered by a padding material 3 to provide a comfortable, secure grip.

One end of the main section 2 is threaded to receive an end cap 4. The end cap 4 secures an end plate 5 across the threaded end of the main section 2. A leaf spring 6 is riveted to the center of the end plate 5 for holding the baton 1 in the retracted position.

Opposite the threaded end, the main section 2 is swaged down to a reduced diameter. The baton 1 includes two coaxial telescoping sections 10 and 11 of progressively decreasing diameter. The larger telescoping section 10 is flared on one end to mate with the swaged end of the main section 2 in the extended position (FIG. 2). The other end of telescoping section 10 is swaged to mate with a flare on the smaller telescoping section 11. A smooth knob 12 is threaded onto the end of the smaller section 11 to allow the baton 1 to be used for control or defense with a reduced risk of inflicting serious or permanent injury.

The diameter of each section 2, 10 and 11 is sized to allow nesting of each section 10 and 11 inside the next larger section 2 or 10, respectively, in the retracted position (FIG. 1). Although three sections 2, 10 and 11 are shown in this embodiment, it should be apparent to one skilled in the art that the number of sections, the retracted length, and the extended length are arbitrary. Batons of two or four sections are also practical. Batons of five or more sections are possible, but are not as practical. Three sections are preferred for providing a compact retracted size without an excessive number of joints 15 in the extended position.

Similarly, while the embodiment shown has a retracted length of approximately six inches and an extended length of approximately 16 inches, full length batons of 36 inches or more are popular as replacements for conventional fixed length night sticks. In fact, as the length increases, the need for rigidity and strength at the joints 15 increases dramatically, all of which imparts a greater importance to the strength and rigidity afforded by this invention.

Each joint 15 is a deadlock taper joint formed by a flared end of one section 10 or 11 being jammed tightly into the mating swage on the adjacent section 2 or 10, respectively. This type of joint 15 requires great strength to perform adequately.

In order to provide adequate strength for the joints 15 and the sections 2, 10 and 11, while still maintaining ease of workability for the sections 2, 10 and 11, a baton 1 according to this invention is constructed using a heat treatable alloy steel for the sections 2, 10 and 11. The particular steel preferred in this embodiment 4130 steel, and the method used for forming the sections 2, 10 and 11 is as follows.

Heat treatable steel has heretofore not been used in the manner of this invention and therefore has not been available as tubing stock. It has therefore been necessary for this invention to first fabricate the heat treatable steel alloy into the tubing sizes needed for the sections 2, 10 and 11. The preferred method is to form the tubing as seamless cold drawn 4130 alloy steel. The tubing is prepared in three sizes corresponding to the different basic diameters of the sections 2, 10 and 11 before swaging and flaring.

Once the tubing has been drawn and cut to an appropriate length for each respective section 2, 10 and 11, the tubing sections are annealed. The annealing softens the tubing and allows the swages and flares to be easily formed without cracking or introducing stress. The annealing is performed by maintaining the tubing at 1350° Fahrenheit (F) in an endothermic atmosphere for one hour, then gas cooling for about one hour until below 800° F.

After the tubing has been softened by the above described annealing process, the tubing is formed into the sections 2, 10 and 11. The smaller section 11 is flared on one end and tapped on the other end to receive the knob 15. The larger section 10 is swaged on one end and flared on the other. The main section 2 is swaged on one end and threaded on the other to receive the end cap 4.

After forming, the respective sections 2, 10 and 11 are hardened to give them the necessary rigidity and strength for the joints 15. Hardening is performed by an austempering process comprising the steps of heating in a neutral salt at 1500° F. for 30 minutes and then cooling in an agitated austempering salt for one hour at 650° F. The resulting hardness ranges from 38 to 43 Rockwell C scale, with hardnesses of 41–42 being typical.

The hardened sections 2, 10 and 11 are then assembled. The smaller section 11 is inserted through section 10 and the knob 15 is threaded onto section 11. The assembly of sections 10 and 11, and knob 15 is then inserted through main section 2. Finally, the end plate 5 is placed over the back of the main section 2 and the end cap 4 is threaded onto the main section 2.

It should be appreciated by those skilled in the art that many variations of the above described preferred embodiments are possible under this invention. For example, many techniques are known, other than those described, for annealing and hardening of heat treatable alloy steels which may be equally used with this invention. Specifically, induction heating as a part of the heat treating process is equally applicable. Similarly, other types of heat treatable steel may be used other than the specific type described. Finally, it should be appreciated that other types of joints 15 may be used, including twist lock, threaded, and many other types of known joints 15 for locking the baton in the extended position. Any joint 15 benefits from the increased strength afforded by this invention.

I claim:

1. An expandable baton formed of an annealed material and subsequently heat treated after forming for strengthening the baton for use as an impact intermediate force weapon, comprising:

a. a main member including a hollow cylindrical tube having opposite open ends, the main member having a wall thickness and an inner diameter and an outer diameter, a portion of the cylinder adjacent one of said ends formed into a swaged end portion of predetermined length for defining a reduced section of the main member wherein both the inner diameter and the outer diameter of the main member are continuously decreasing such that the wall thickness is substantially constant throughout the reduced section;

b. a removable cap adapted to close the other open end of the main member;

c. a substantially cylindrical telescoping member including a hollow cylindrical tube having opposite open ends, the telescoping member having a wall thickness and an outer diameter which is smaller than the inner diameter of the main section and an inner diameter, the telescoping member adapted to be received in the other open end of the main section and slidably carried in the main section, a portion of the cylindrical tube adjacent one open end of the telescoping section formed into a flare portion of predetermined length for defining an expanded section wherein both the outer diameter and the inner diameter of the telescoping member are continuously increasing throughout the expanded section such that the wall thickness is substantially constant throughout the expanded section, said telescoping member movable between a retracted position wherein the telescoping member is housed in the main member and an extended position wherein the telescoping member is extended outwardly through the end adjacent the reduced section of the main member, with the expanded section of the telescoping member engaging the reduced section of the main member with the flare portion of the telescoping member jammed tightly into the swaged portion of the main member.

2. The expandable baton of claim 1, which includes a plurality of telescoping members, each telescoping member being formed with a heat treatable alloy steel and in which telescoping members are configured such that the swaged portion on one end of each of the telescoping members is adapted to be placed in mating engagement with the flared portion on one end of an adjacent member such that the flared portion of one member is jammed into the swaged portion of the adjacent member.

3. The expandable baton of claim 1, further including a retainer means associated with said cap for selectively, releasably retaining the telescoping member in the retracted position, the retaining means having a holding force which is adapted to be released for automatically extending the baton through a swift whipping action of the baton, the retaining means comprising: a leaf spring having a base fixed relative to the cap of the baton and located inside the handle, the leaf spring having a pair of legs extending outwardly from the base for engaging diametrically opposed positions on the inner diameter of the telescoping member when said member is in the retracted position, for providing a balanced holding force on the telescoping member for retaining the telescoping member in the retracted position.

4. The expandable baton of claim 1, further including padding material covering the main member of the baton.

* * * * *

UNITED STATES PATENT AND TRADEMARK OFFICE

CERTIFICATE OF CORRECTION

PATENT NO. : 5,348,297

DATED : September 20, 1994

INVENTOR(S) : Kevin L. Parsons

It is certified that error appears in the above-indentified patent and that said Letters Patent is hereby corrected as shown below:

On the Title page, in item [*] Notice:, please change "The portion of the term of this patent subsequent to Jun. 21, 2005 has been disclaimed" to read --The Portion of the term of this patent subsequent to Dec. 22, 2006 has been disclaimed--.

Signed and Sealed this

Fifth Day of August, 1997

Bruce Lehman

*Attest:*

BRUCE LEHMAN

*Attesting Officer*

*Commissioner of Patents and Trademarks*